US006050872A

United States Patent [19]

Cahill et al.

[11] Patent Number: 6,050,872

[45] Date of Patent: Apr. 18, 2000

[54] TOY CARWASH UNIT

[76] Inventors: Douglas R. Cahill, 2291 Hebron Ave; John W. Anders, P.O. Box 1014, both of Glastonbury, Conn. 06033

[21] Appl. No.: 09/059,846

[22] Filed: Apr. 14, 1998

[51] Int. Cl.[7] ..... A63H 33/00

[52] U.S. Cl. ..... 446/89; 446/153; 446/475; 239/279; 239/289

[58] Field of Search ..... 446/89, 153, 423, 446/475, 479, 483; 472/128; 239/276, 279, 289

[56] References Cited

U.S. PATENT DOCUMENTS

| | | | |
|---|---|---|---|
| 648,263 | 4/1900 | Hull | 239/276 |
| 986,003 | 3/1911 | Hohenstein | 239/276 |
| 3,170,171 | 2/1965 | Mayhew et al. . | |
| 3,539,181 | 11/1970 | Larsen . | |
| 3,593,454 | 7/1971 | Einfalt . | |
| 3,701,356 | 10/1972 | Hanna et al. . | |
| 3,752,472 | 8/1973 | Snead . | |
| 3,866,916 | 2/1975 | Clarke | 472/128 |
| 4,356,657 | 11/1982 | Goldfarb et al. . | |
| 4,936,330 | 6/1990 | LaHue | 239/276 |
| 5,015,210 | 5/1991 | Dideriksen | 446/423 |
| 5,152,727 | 10/1992 | Moore et al. | 239/289 |
| 5,469,587 | 11/1995 | Demeny | 239/279 |
| 5,480,336 | 1/1996 | Blanchard | 446/89 |
| 5,649,867 | 7/1997 | Briggs | 472/128 |

OTHER PUBLICATIONS

Kenner's Girder & Panel Hydro–Dynamic Building Set # 11, Advertisent, "Playthings" vol 62 #7, pp. 113–114, Jul. 1964.

*Primary Examiner*—Robert A. Hafer
*Assistant Examiner*—Jeffrey D. Carlson
*Attorney, Agent, or Firm*—Ira S. Dorman

[57] ABSTRACT

A toy carwash unit is comprised of a self-supporting, free-standing frame, a water-carrying conduit supported by the frame, and at least one water-spray head. The several pieces from which the frame is assembled form two inverted, generally U-shaped subassemblies, joined to one another by a crosspiece on which the spray head is mounted. The unit is devoid of any ground-level structure that would interfere substantially with the passage of a vehicle to a washing location within the frame, and it is readily disassembled.

10 Claims, 5 Drawing Sheets

TOY CARWASH UNIT

BACKGROUND OF THE INVENTION

Children derive much pleasure from the imitation of common adult activities, and many toys that promote, facilitate, and stimulate such play are commercially available. The present invention provides a toy carwash unit through which a vehicle may be "driven" and subjected to cleaning by water sprays.

A toy carwashing bay is referred to in Einfalt U.S. Pat. No. 3,593,454, and Goldfarb et al. U.S. Pat. No. 4,356,657 is directed to a toy car wash apparatus. A full-size car washing system is disclosed in Hanna et al. U.S. Pat. No. 3,701,356; a shower hoop is provided by Mayhew et al. U.S. Pat. No. 3,170,171; Larsen U.S. Pat. No. 3,539,181 provides an outdoor gym set that can be connected to a water supply; a child's building toy comprised of components that can be interconnected for water passage is provided by Snead U.S. Pat. No. 3,752,472; and Blanchard U.S. Pat. No. 5,480,336 provides a toy construction kit with ductwork for water flow.

SUMMARY OF THE INVENTION

A demand exists for a toy that is suitable for use by children for imitating carwashing activities, and it is therefore the broad object of the present invention to provide a toy carwash unit that enables such play. More specific objects of the invention are to provide a toy carwash unit that is of incomplex design, is comprised of simple components that are readily assembled and disassembled, easily packaged for retail sale, is highly functional for its intended purposes, and is of durable and relatively inexpensive construction and manufacture.

It has now been found that the foregoing and related objects of the invention are attained by the provision of a toy carwash unit comprised of a self-supporting, free-standing, readily disassembled frame, a separate water-carrying conduit supported by the frame along at least a portion of its length, and at least one water-discharge head (usually, a spray head). The frame comprises a multiplicity of elongate members; i.e., at least four leg pieces, terminating in ground-engaging elements, at least two overhead pieces, and at least one crosspiece. The upper end portions of the leg pieces, and the opposite end portions of the overhead pieces, are constructed for mutual interengagement and are so interengaged as to thereby produce two generally U-shaped subassemblies, each comprised of two leg pieces and an overhead piece. The opposite end portions of the crosspiece, and the intermediate portions of the overhead pieces, are similarly constructed for mutual interengagement and are so interengaged as to thereby support the crosspiece in an elevated position, substantially above ground level, between the two subassemblies. The water-discharge head is mounted on the intermediate portion of the crosspiece, and the water-carrying conduit has one end portion connected to the head for supplying water to it. The unit is devoid of any ground-level structure that would interfere significantly with the passage of a vehicle to a washing position beneath the water-discharge head.

Generally, the elongate members will be substantially rectilinear and tubular, and the supported length portion of the water-carrying conduit will preferably be contained within the frame. The mutually interengaged portions of the pieces may be slip-fitted to one another and joined by frictional interengagement, and/or they may be threadably interengaged. Each leg piece will advantageously have an enlarged ground-contacting element on its lower end portion, for enhanced support and stability of the frame, and one of the leg pieces may mount a hose connector that is constructed for connection to the end portion of the water-carrying conduit; the connector may be adopted for the additional connection thereto of a separate water-spray hose.

DETAILED DESCRIPTION OF THE PREFERRED AND ILLUSTRATED EMBODIMENTS

Figure 1:
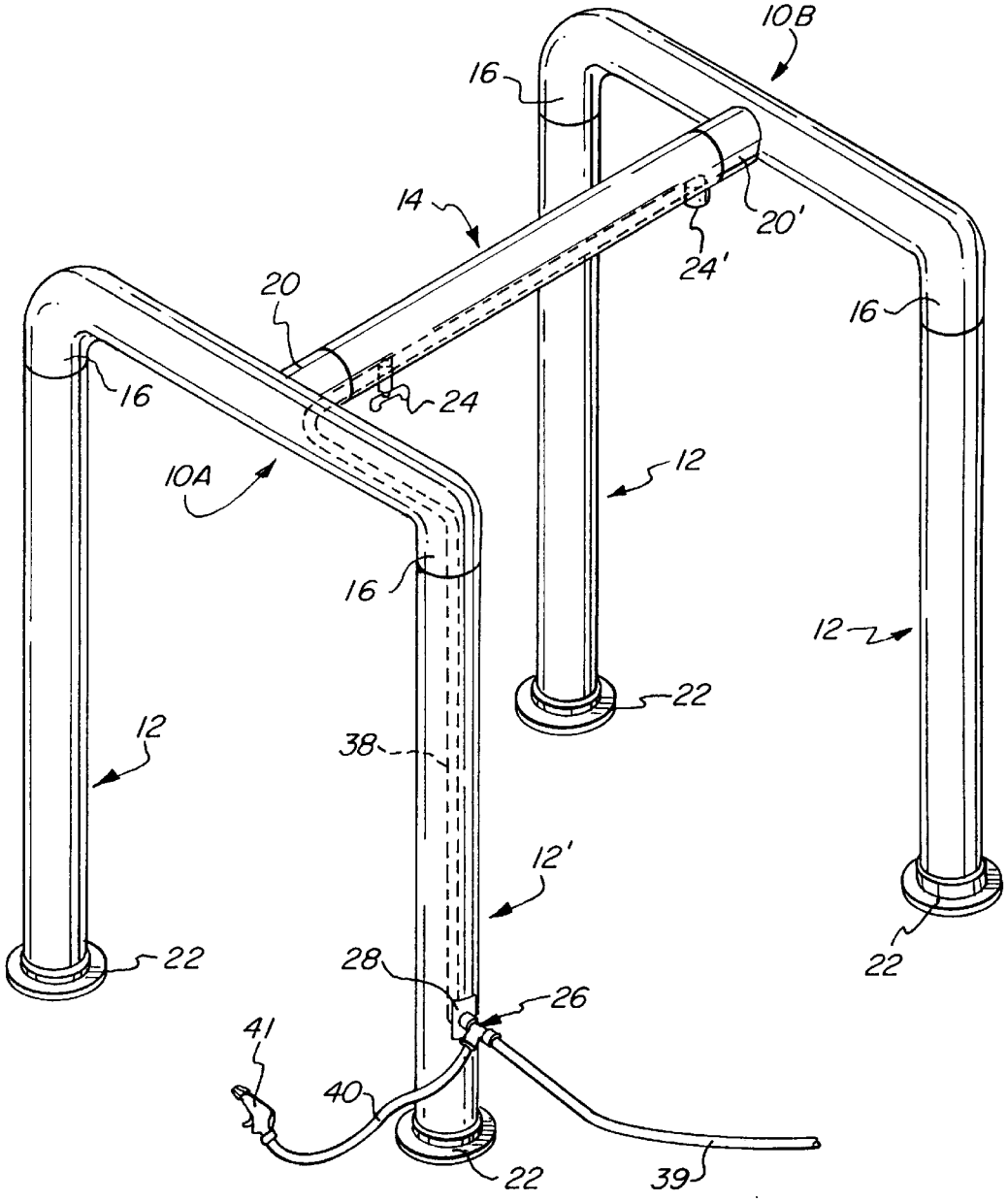
FIG. 1 is a perspective view of a toy carwash unit embodying the present invention.
Figure 2:
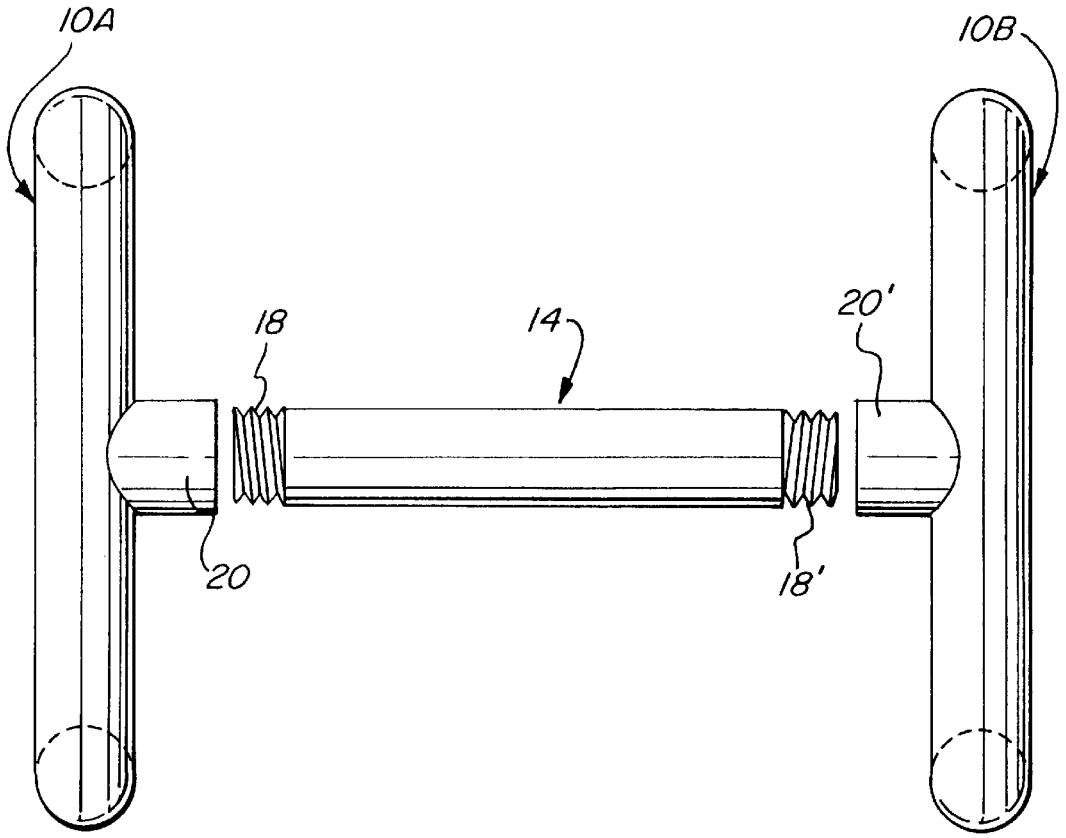
FIG. 2 is an exploded plan view of the carwash unit of FIG. 1.
Figure 3:
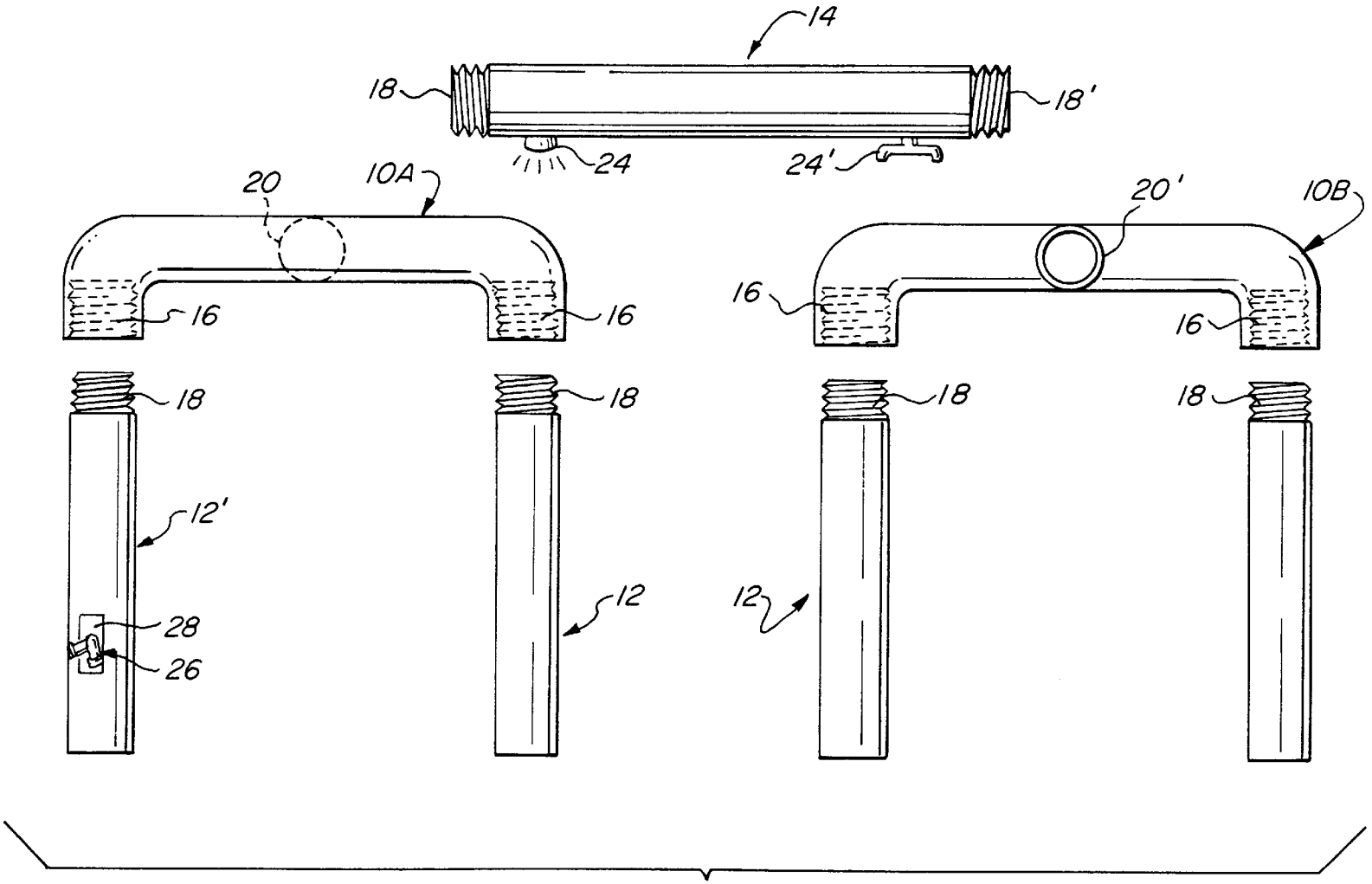
FIG. 3 is an elevational view showing the seven tubular components of which the frame of the carwash unit is assembled.
Figure 4B:
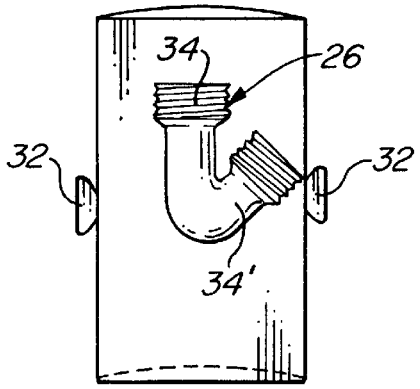
FIG. 4B is a rear view of the fixture subassembly itself.
Figure 4A:
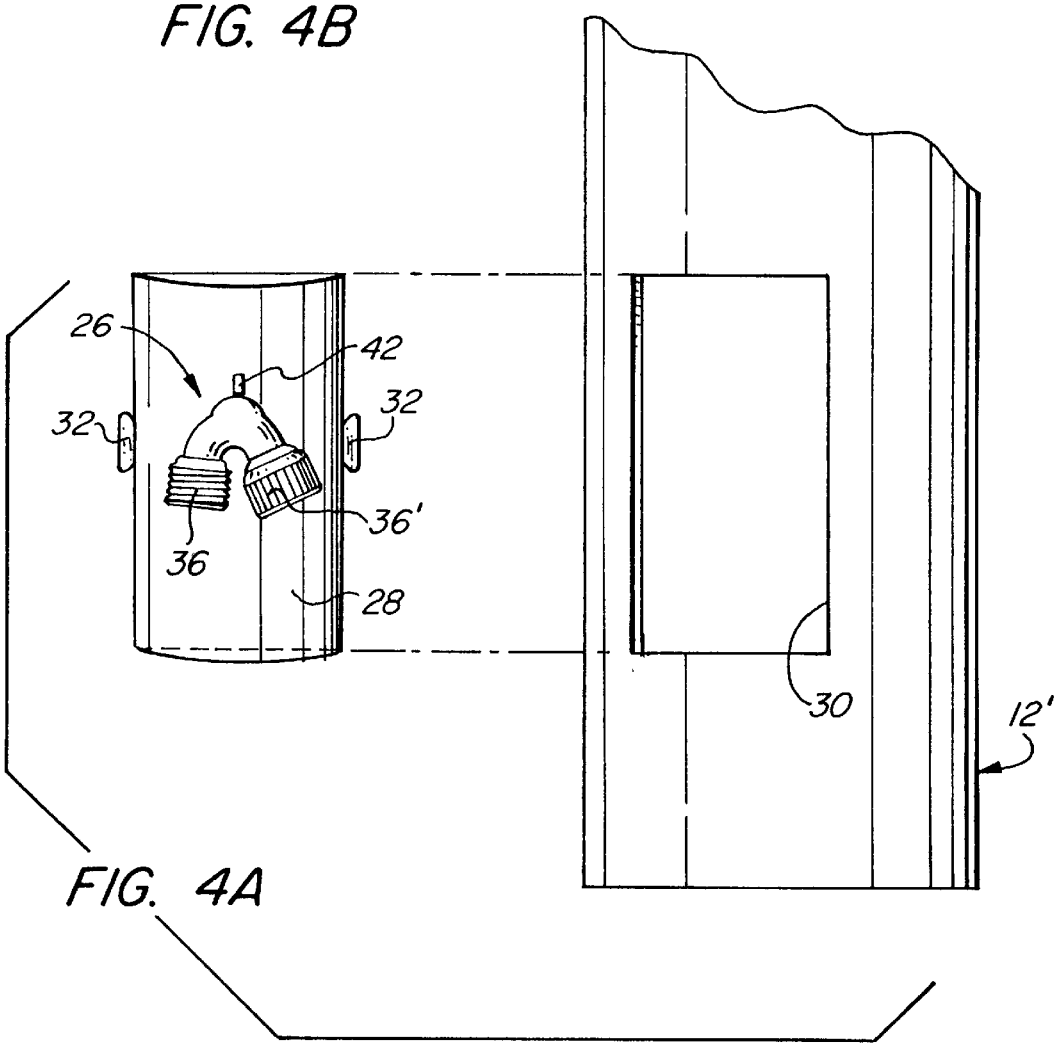
FIG. 4A is an exploded fragmentary view showing one of the leg pieces of which the unit is comprised, and the water fixture subassembly installed thereon.

Turning initially to FIGS. 1 through 5 of the drawings, therein illustrated is a toy carwash unit embodying the present invention and comprised of a pair of overhead pieces, generally designated by the numerals 10A and 10B, four leg pieces generally designated by the numerals 12 and 12', and a crosspiece generally designated by the numeral 14; each of the pieces 10, 12, 14 is of tubular, generally rectilinear form (typically being fabricated from PVC piping). The overhead pieces 10A and 10B are formed with right-angle bends to produce depending connecting portions 16 at their opposite ends, and they are provided with laterally extending collar elements 20, 20' at intermediate locations (midway between the ends, in the embodiment shown). The connecting portions 16 and the elements 20 are internally threaded; element 20' is distinguished from element 20 by having an opposite thread direction, and the end portions 18, 18' on the crosspiece 14 have corresponding male threads. It will be appreciated that the provision of reverse threads will enable facile disengagement of the crosspiece 14 from the overhead pieces 10A, 10B, simultaneously, by rotation of the crosspiece about its longitudinal axis. Annular flange elements 22 are secured at the bottom ends of the legs 12 to provide enhanced stability and support for the assembled frame.

Two spray head structures 24, 24' extend outwardly through the wall of an intermediate portion of the crosspiece 14. A coupling fixture or connector, generally designated by the numeral 26, is mounted upon a plate 28, which is in turn seated within a rectangular opening 30 formed through the wall of the leg 12'; the plate is held in place by engagement of the laterally extending tabs 32 behind the margins of the opening 30.

The coupling fixture 26 is formed with two inside branches 34, 34' and two outside branches 36, 36'. A length of hose 38 passes through the leg 12' and the adjacent portions of the overhead piece 10A and the crosspiece 14, for connection to the more proximate of the two spray head structures 24. A branch from the hose 38 may be employed to supply water to the more remote spray head structure 24', or a separate length of hose may connect it directly to the second inside fixture branch 34'. The outside branch 36 of the fixture 26 is connected to the water supply (not seen) by a length of hose 39, and another length of hose 40 connects the outside branch 36' to a manually operated spray nozzle 41. A valve within the coupling fixture 26 can be operated to selectively direct water to either the spray head structure 24 or the manual nozzle 41, using the handle 42.

As will be appreciated, disassembly of the carwash unit is readily achieved simply by unscrewing the legs 12, 12' and the crosspiece 14 from the overhead pieces 10A 10B. The internal length of hose 38 can then be disconnected, at one or both ends, and withdrawn for storage if so desired.

Figures 5, 6:
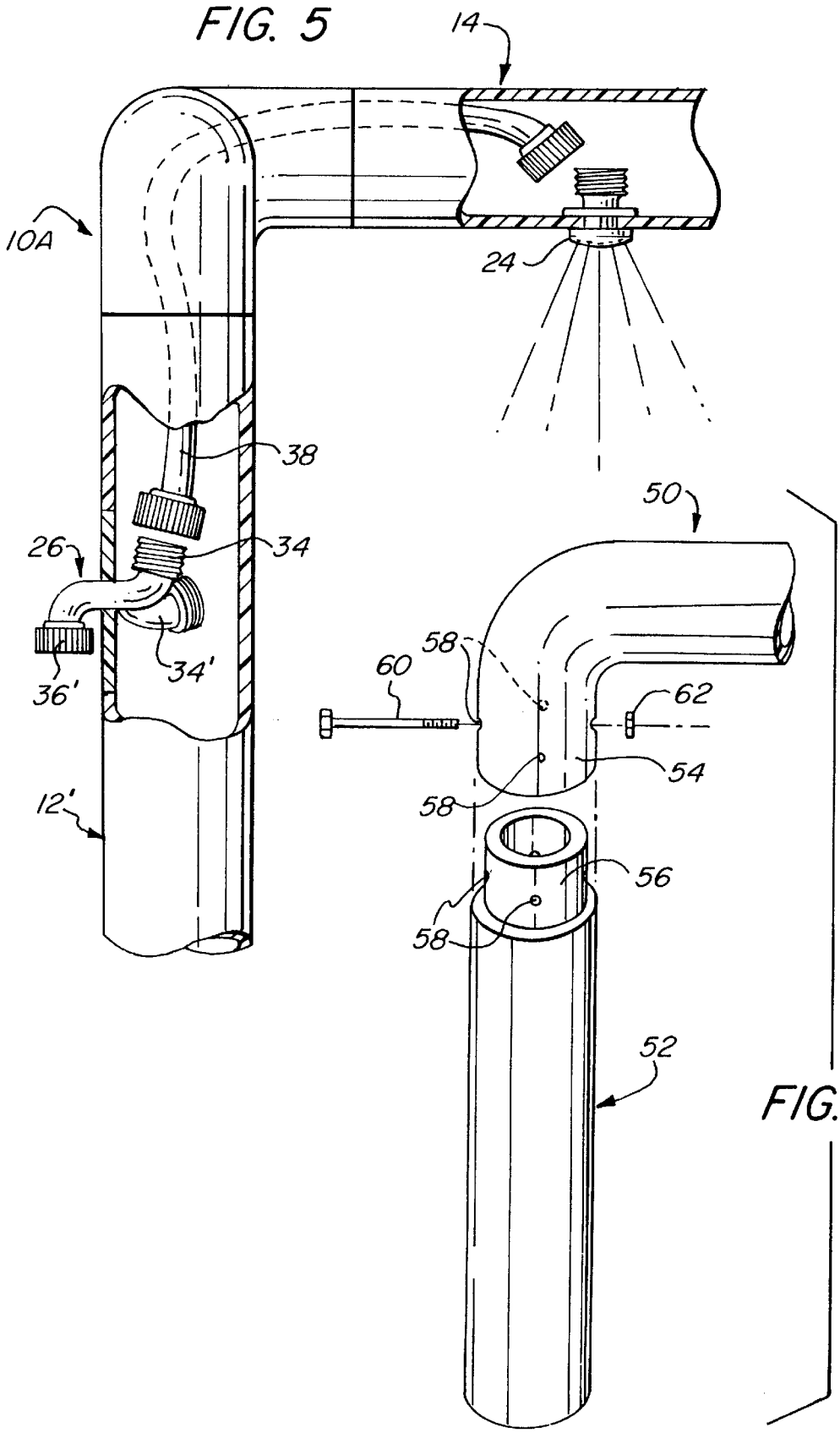
FIG. 5 is a fragmentary elevational view, in partial section, showing the fixture subassembly and one of the spray heads of the carwash unit, with a connecting length of flexible hose disposed therebetween.
FIG. 6 is a fragmentary perspective view showing an alternative form of a leg piece and an overhead piece for the carwash unit of the invention, providing a slip fit connection joint for the interengagement thereof.

FIG. 6 depicts an alternative form of the frame components, in which slip-fit connections are used in place of the threaded joints previously described. An overhead piece and a leg piece, generally designated respectively by the numerals 50 and 52, are representative and are provided with cylindrical end portions 54 and 56, dimensioned and configured for mutual frictional interengagement. Four small apertures 58 are formed at 90° intervals through each of the portions 54 and 56 for alignment to receive two bolts 60 (only one of which is illustrated) secured by nuts 62. The sets of aligned apertures are disposed at different levels to permit receipt of the crossing bolts 60 without mutual interference.

Although the frame of the illustrated carwash unit is assembled from hollow members, and the use of such members constitutes the best mode presently contemplated for carrying out the invention, it will be appreciated that solid pieces could be substituted if so desired. In such an embodiment the water-carrying conduit(s) would of course have to be mounted on the outside of the frame, and suitable modifications would have to be made to enable connections to the several fixtures. similarly, while lengths of flexible hose will usually serve most conveniently as the water-carrying conduits, other forms of tubing or piping can be substituted if preferred.

The constituent frame members will themselves usually afford adequate rigidity and support for the frame, without need for added reinforcing elements. It is important that the unit be devoid of any ground-level structure that would interfere with the passage of a play vehicle between the two U-shaped subassemblies, and thereby diminish the child's perception of realism in the model. Thus, the child would want to "drive" his vehicle unimpeded to a location directly beneath the spray-heads, and to then proceed outwardly after the washing operation has been completed. If reinforcement is nevertheless found to be necessary or desirable in any given case, elements that lie substantially flush against the ground may be employed without significant detriment. Although the illustrated unit utilizes only a minimum number of components, it will be appreciated that more complex structures may for example include a plurality of crosspieces, a multiplicity of overhead pieces, and more than four legs.

Thus, it can be seen that the present invention provides a novel toy carwash unit which is of incomplex design, is comprised of simple components that are readily assembled and disassembled, easily packaged for retail sale, is highly functional for its intended purposes, and is of durable and relatively inexpensive construction and manufacture.

Having thus described the invention, what is claimed is:

1. A drive-through toy carwash unit comprised of a self-supporting, free-standing, readily disassembled frame, a separate water-carrying conduit supported within said frame along at least a portion of its length, and at least one water-discharge head, said frame comprising a multiplicity of elongate members disengageably interfitted with one another, including at least four leg pieces, at least two overhead pieces, and at least one crosspiece, each of said leg pieces having an upper end portion and a lower end portion terminating at a ground-contacting element, and each of said overhead pieces and said crosspiece having opposite end portions with intermediate portions therebetween, said upper end portions of said leg pieces and said opposite end portions of said overhead pieces being constructed for mutual interengagement so as to form two generally U-shaped subassemblies, each of said subassemblies being comprised of two of said leg pieces and one of said overhead pieces joined by interengagement of said upper end portions and said opposite end portions thereof, respectively, and said opposite end portions of said crosspiece and said intermediate portions of said overhead pieces being constructed for mutual interengagement so as to support said crosspiece between said U-shaped subassemblies with said subassemblies spaced laterally from one another, said crosspiece being elevated substantially above ground level with said ground-contacting elements on said lower end portions of said leg pieces in ground-engaging contact and said subassemblies in inverted orientation; said at least one water-discharge head being supported on said intermediate portion of said crosspiece; and said conduit having one end portion connected to said water-discharge head and an opposite end portion constructed for operative connection to a water supply for the delivery of water through said conduit to said water-discharge head, said unit being devoid of any structure that would interfere significantly with the passage of a vehicle on the ground and at least in the longitudinal direction of said crosspiece, between said two subassemblies.

2. The unit of claim 1 wherein each of said elongate members is substantially rectilinear.

3. The unit of claim 1 wherein each of said elongate members is tubular.

4. The unit of claim 1 wherein at least certain of said mutually interengaged portions of said pieces are threaded and are threadably interengaged with one another.

5. The unit of claim 1 wherein at least certain of said mutually interengaged portions of said pieces are slip-fitted to one another and are joined by frictional interengagement.

6. The unit of claim 1 wherein said crosspiece is disposed substantially midway between the opposite ends of each of said overhead pieces.

7. The unit of claim 1 wherein said ground-contacting element of said each leg piece is enlarged, relative to the exterior peripheral dimensions of the reminder of said lower end portion thereof, said ground-contacting element extending outwardly about the periphery of said each leg piece for enhanced support and stability of said frame.

8. The unit of claim 1 further including at least a second water-discharge head supported on said intermediate portion of said crosspiece, said second water-discharge head having means for connection to a water-carrying conduit.

9. The unit of claim 1 further including a hose connector on one of said leg pieces, said hose connector being constructed for connection to said opposite end portion of said water-carrying conduit and to a water-supply conduit for operatively connecting said water-carrying conduit to the water-supply conduit.

10. The unit of claim 9 wherein said unit further includes a water-spray hose, said hose connector being constructed for the additional connection thereto of said water-spray hose.

* * * * *